US012146202B2

(12) United States Patent
Barbier et al.

(10) Patent No.: US 12,146,202 B2
(45) Date of Patent: Nov. 19, 2024

(54) PROCESS FOR MANUFACTURING THIN SHEETS MADE OF 7XXX ALUMINUM ALLOY SUITABLE FOR SHAPING AND ASSEMBLY

(71) Applicant: CONSTELLIUM NEUF-BRISACH, Biesheim (FR)

(72) Inventors: David Barbier, Grenoble (FR); Jean-Philippe Masse, Grenoble (FR); Olivier Rebuffet, Grenoble (FR); Laurent Cervi, Saint Jean de Moirans (FR)

(73) Assignee: CONSTELLIUM NEUF-BRISACH, Biesheim (FR)

( * ) Notice: Subject to any disclaimer, the term of this patent is extended or adjusted under 35 U.S.C. 154(b) by 836 days.

(21) Appl. No.: 17/259,341

(22) PCT Filed: Jul. 11, 2019

(86) PCT No.: PCT/FR2019/051739

§ 371 (c)(1),
(2) Date: Jan. 11, 2021

(87) PCT Pub. No.: WO2020/016506

PCT Pub. Date: Jan. 23, 2020

(65) Prior Publication Data

US 2021/0292861 A1 Sep. 23, 2021

(30) Foreign Application Priority Data

Jul. 17, 2018 (FR) ..... 1856613

(51) Int. Cl.
*C22F 1/053* (2006.01)
*B21D 22/02* (2006.01)
(Continued)

(52) U.S. Cl.
CPC ..... *C21D 8/0226* (2013.01); *B21D 22/022* (2013.01); *C21D 8/0236* (2013.01);
(Continued)

(58) Field of Classification Search
None
See application file for complete search history.

(56) References Cited

U.S. PATENT DOCUMENTS 8,613,820 B2 12/2013 Smeyers et al.
2005/0034794 A1* 2/2005 Benedictus ..... C22C 21/10 148/552
(Continued)

FOREIGN PATENT DOCUMENTS

EP 2440680 A1 4/2012
EP 2479305 A1 7/2012
(Continued)

OTHER PUBLICATIONS

International Search Report of International Patent Application No. PCT/FR2019/051739 dated Nov. 27, 2019.

*Primary Examiner* — George Wyszomierski
(74) *Attorney, Agent, or Firm* — McBee Moore & Vanik IP, LLC

(57) ABSTRACT

The invention relates to the process for manufacturing a rolled product based on an aluminum alloy, in particular for the automotive industry wherein, successively, a bath of liquid metal made from an aluminum-based alloy. The invention also relates to the products obtained by this process and the use thereof for the manufacture of a motor vehicle.

23 Claims, 2 Drawing Sheets

(51) Int. Cl.

| | |
|---|---|
| ***C21D 8/02*** | (2006.01) |
| ***C21D 9/46*** | (2006.01) |
| ***C22C 21/10*** | (2006.01) |

(52) U.S. Cl.
CPC ..... *C21D 9/46* (2013.01); *C22C 21/10* (2013.01); *C22F 1/053* (2013.01)

(56) References Cited

U.S. PATENT DOCUMENTS

| | | | | |
|---|---|---|---|---|
| 2013/0216790 | A1* | 8/2013 | Smeyers | C22C 21/10 148/537 |
| 2016/0160332 | A1 | 6/2016 | Kamat et al. | |
| 2017/0016102 | A1* | 1/2017 | Nakanishi | C22F 1/002 |
| 2017/0121802 | A1* | 5/2017 | Kamat | B64C 1/06 |
| 2019/0062886 | A1* | 2/2019 | Leyvraz | C22F 1/053 |

FOREIGN PATENT DOCUMENTS

| | | | |
|---|---|---|---|
| EP | 2514537 | A1 | 10/2012 |
| EP | 3265595 | A1 | 1/2018 |
| WO | 2009130175 | A1 | 10/2009 |
| WO | 2012/059505 | A1 | 5/2012 |
| WO | 2014/040939 | A1 | 3/2014 |
| WO | 2014/159647 | A1 | 10/2014 |
| WO | 2015132932 | A1 | 9/2015 |
| WO | 2016/094464 | A1 | 6/2016 |
| WO | 2017/075319 | A1 | 5/2017 |

* cited by examiner

PROCESS FOR MANUFACTURING THIN SHEETS MADE OF 7XXX ALUMINUM ALLOY SUITABLE FOR SHAPING AND ASSEMBLY

CROSS-REFERENCE TO RELATED APPLICATIONS

This application is a National Stage entry of International Application No. PCT/FR2019/051739, filed 11 Jul. 2019, which claims priority to French Patent Application No. 1856613, filed 17 Jul. 2018.

BACKGROUND

Field

FIELD OF THE INVENTION

This invention relates to a process for manufacturing thin sheets made of 7XXX aluminum alloy, which are particularly useful for the automotive industry.

Description of Related Art

Various aluminum alloys are used in the form of sheets or blanks for applications in the automotive sector. Of these alloys, AA7XXX series aluminum alloys, such as alloy AA7075, combine desirable chemical and mechanical properties such as hardness and corrosion resistance. However, AA7XXX alloys are not yet widely used in the automotive industry because of the difficulties encountered in shaping and assembling them, while maintaining a cost-effective manufacturing process.

A high temperature shaping treatment can be performed in order to improve shaping. Patent application AT11744, for example, describes a process for producing a part shaped from a 7000 series aluminum alloy sheet, wherein the aluminum sheet is heated and shaped in this heated state and then cooled.

Patent application EP3265595 describes an alloy comprising as a % by weight 4-15 Zn, 0.1-3.5 Cu, 1.0-4.0 Mg, 0.05-0.50 Fe, 0.05-0.30 Si, 0.05-0.25 Zr, up to 0.25 Mn, up to 0.20 Cr, up to 0.15 Ti, up to 0.15% impurities, the remainder being aluminum, which can be specifically used in the automotive industry.

Patent application WO2016094464 describes a process for achieving the desired strength and elongation with a 7xxx aluminum alloy sheet comprising the steps of a) rapidly heating the sheet to a temperature of 450° C. to 510° C., b) maintaining the sheet at a temperature of 450° C. to 510° C. for 20 minutes, c) rapidly cooling the sheet to ambient temperature at more than 50° C. per second, d) heating the sheet to a temperature of between approximately 50° C. and 150° C., e) maintaining the sheet at a temperature of between approximately 50° C. and 150° C. for a period of approximately 0.5 to 6 hours.

Patent application WO2014040939 relates to a process for manufacturing a part of a motor vehicle comprising at least the steps consisting of: (a) providing a bare or composite rolled aluminum alloy produced from a sheet with a thickness in a range of approximately 0.5 mm to 4 mm, wherein the sheet product comprises at least one layer made of an AA7xxx series aluminum alloy, the sheet product having been subject to solution heat treatment and quenching, followed by a natural aging period of at least 1 day, (b) subjecting the naturally aged sheet product to a reversion annealing treatment, i.e. heat treatment at a temperature of between 100° C. and 350° C. for 0.1 to 60 seconds, (c) possibly subjecting the heated sheet product to a forced cooling operation, (d) within 2 hours, preferably within 30 minutes, from the reversion annealing treatment, shaping the sheet product to obtain a three-dimensional part.

Patent application WO2012059505 describes a process for manufacturing an aluminum alloy shaped part for a motor vehicle, the process comprising: (a) providing a rolled aluminum sheet product, wherein the aluminum alloy is an AA7000 with a thickness in the range of 0.5 to 4 mm and having been subject to solution heat treatment and having been cooled, (b) shaping the aluminum alloy sheet to obtain a three-dimensional shaped part, (c) heating said three-dimensional shaped part to at least a pre-aging temperature of between 50-250° C., and (d) subjecting said shaped part and the pre-aged motor vehicle component to a paint baking cycle.

Patent application EP2514537 describes a process for manufacturing a joint in at least two metal parts that overlap by means of self-piercing riveting. At least one of the first part and the second part is a sheet material made of an AA7000 series aluminum alloy, and a heat treatment is applied to at least the part made of said 7000 series material within 120 minutes prior to production of the assembly and/or at least a part of the time during production of the assembly so as to reduce the tensile strength in the junction area of at least the part made of said 7000 series sheet material.

Patent application EP2479305 relates to a process for manufacturing an aluminum alloy structural part comprising: (a) providing a rolled aluminum sheet product, wherein the aluminum alloy is from the AA7000 series and has a thickness in the range of 0.5 to 4 mm and has been subject to solution heat treatment and has been cooled, (b) shaping the aluminum alloy sheet to obtain a three-dimensional shaped part, (c) cooling the shaped sheet to a temperature below zero (T1) by immersion in a coolant, and enabling the shaped part to reach equilibrium at this temperature, (d) heating from the temperature below zero (T1) to a temperature T2 above 40° C., followed by cooling to ambient temperature, and (e) subjecting said motor vehicle component to a paint baking cycle.

Patent application EP2440680 describes a process for manufacturing a part of a motor vehicle, having a yield strength above 500 MPa after having been subject to a paint baking cycle, the process comprising: (a) providing a rolled aluminum sheet product made of a AlZnMgCu alloy and having a thickness in the range of 0.5 to 4 mm and having been subject to solution heat treatment, and having been quenched and in which the microstructure is substantially recrystallized, (b) shaping the aluminum alloy sheet to obtain a shaped part, (c) assembling the shaped part with one or more other metal parts to form an assembly forming a motor vehicle component, (d) subjecting said motor vehicle component to a paint baking cycle and wherein the aluminum alloy sheet in the shaped part has a yield strength above 500 MPa.

Patent application WO2009130175 relates to a manufacturing process consisting of shaping a structural part from a 7xxx series aluminum alloy sheet, the process comprising the following steps: (i) cutting the aluminum alloy sheet to obtain a blank, (ii) heating the blank to a temperature above 450° C., (iii) shaping the blank heated in this way, (iv) cooling (v) heat treating the cooled and shaped structural part.

Patent application WO2015132932 relates to a structural aluminum alloy sheet and a process for manufacturing the aluminum alloy sheet, the aluminum alloy sheet containing 7.0 to 12.0% by mass of Zn, 1.5 to 4.5% by mass of Mg, 1.0 to 3.0% by mass of Cu, 0.05-0.30% by mass of Zr and 0.005 to 0.5% by mass of Ti and having a reduced Si content of 0.5% by mass or less, a reduced Fe content of 0.5% by mass or less, a reduced Mn content of 0.3% by mass or less and a reduced Cr content of 0.3% by mass or less, the remainder comprising inevitable impurities and aluminum.

Patent application WO2017075319 relates to 7xxx series aluminum alloys having a high strength, intended specifically for automotive applications, these alloys comprising as a % by weight, 4-15 Zn, 0.1-3.5 Cu, 1.0-4.0 Mg, 0.05-0.50 Fe, 0.05-0.30 Si, 0.05-0.25 Zr, up to 0.25 Mn, up to 0.20 Cr, up to 0.15 Ti and up to 0.15 impurities, the remainder being aluminum.

There is a need for rolled products, typically with a thickness of 0.5 to 4 mm, in an aluminum-zinc-copper-magnesium alloy with improved properties in comparison to those of known products, in particular in terms of suitability for shaping and for assembly, while having high mechanical strength and being stress corrosion resistant after paint baking, for the automotive industry. Furthermore, there is a need for a simple and cost-effective process for obtaining these rolled products.

SUMMARY

One object of the invention is a process for manufacturing a rolled product based on an aluminum alloy, in particular for the automotive industry wherein, successively, a) a bath of liquid metal is made from an aluminum-based alloy comprising 4 to 7% by weight of Zn, 1.0 to 3.0% by weight of Cu, 1.5 to 3.5% by weight of Mg, at most 0.50% by weight of Fe, at most 0.40% by weight of Si, at least one element chosen from Zr, Mn, Cr, Sc, Hf and Ti, the amount of said element, if it is chosen, being 0.05 to 0.18% by weight for Zr, 0.1 to 0.6% by weight for Mn, 0.05 to 0.3% by weight for Cr, 0.02 to 0.2% by weight for Sc, 0.05 to 0.5% by weight for Hf and 0.005 to 0.15% by weight for Ti, the other elements being at most 0.05% by weight each and 0.15% by weight in total, the remainder being aluminum, b) a rolling ingot is cast from said bath of liquid metal, c) optionally, said rolling ingot is homogenized, d) said rolling ingot is hot-rolled and optionally cold-rolled to give a sheet, e) said sheet is solution heat treated and quenched, f) optionally, said sheet is leveled and/or subject to controlled traction with cumulative deformation of at least 0.5% and less than 3%, g) heat treatment is performed wherein said quenched sheet reaches a temperature of between 6° and 120° C. for 8 to 16 hours, h) said heat treated sheet is aged for at least 30 days at ambient temperature.

Another object of the invention is a rolled product obtained by means of the process according to the invention having a combination of properties Rp0.2(TL) and A % (TL) such that A % (TL)≥−0.05 Rp0.2(TL)+40 and A % (TL) is equal to at least 17%.

A further object of the invention is the use of a rolled product obtainable by means of the process according to the invention or according to the invention for the manufacture of a motor vehicle.

DETAILED DESCRIPTION OF A PREFERRED EMBODIMENT

Figure 1:
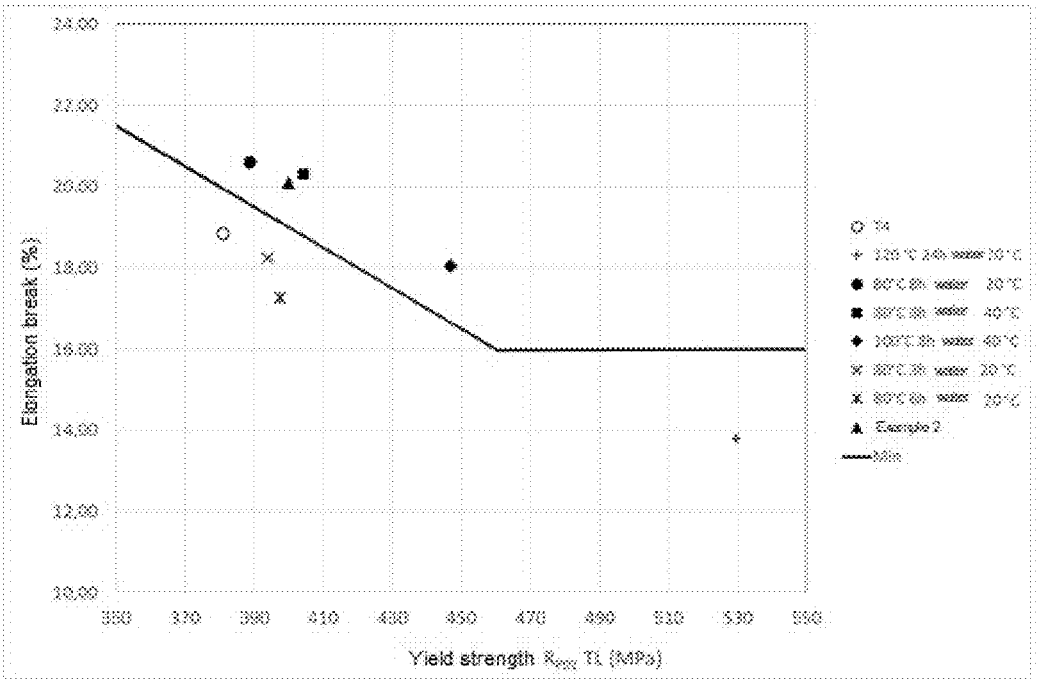
FIG. 1: Relationship between the elongation and the yield strength Rp02 in the direction TL for sheets obtained by means of the process according to the invention after aging for 30 days.

Unless stipulated otherwise, all information relating to the chemical composition of alloys is expressed as a percentage by weight based on the total weight of the alloy. The expression 1.4 Cu means that the copper content expressed as a % by weight is multiplied by 1.4. The alloy designations are provided in accordance with the rules of The Aluminum Association, which are known to a person skilled in the art. Unless stipulated otherwise, the definitions of metallurgical conditions appearing in European standard EN 515 (1993) apply.

The static tensile mechanical properties, in other words, the breaking strength $R_m$, the conventional yield strength at 0.2% of elongation $R_{p0.2}$, and the elongation at break A %, are determined by a tensile test in accordance with standard NF EN ISO 6892-1 (2016), with the sampling and test direction being defined by standard EN 485-1 (2016). The traction direction is indicated by the letter L (longitudinal direction) or TL (long crosswise direction). The test pieces used have a width of 20 mm and a length of 80 mm, i.e. type 2 in accordance with Table B.1 of standard EN ISO 6892-1.

Within the scope of the invention, the mechanical properties are measured at full thickness.

Unless stipulated otherwise, the definitions appearing in standard EN 12258 (2012) apply.

Bendability, as used in this invention, is quantified using an "r/t ratio", which is the relationship between the bending radius (r) and the thickness of the sheet (t), both expressed in mm. The lower the r/t ratio, the more pliable the sheet. The equipment used for measuring is described, for example, in FIG. 2 of patent application US 2016/0168676. Measurements are performed in accordance with standards ASTM E290-97a and the "Ford Laboratory Test Method" (FLTM) BB114-02.

Within the scope of this invention, a granular structure such that the rate of recrystallization is greater than 70% and preferably greater than 90% is known as a substantially recrystallized granular structure. The rate of recrystallization is defined as the fraction of the surface of a metallographic cross section occupied by recrystallized grains.

The present inventors have obtained sheets offering an advantageous compromise between mechanical strength, stress corrosion resistance, formability and suitability for assembly by using the process according to the invention, which specifically comprises the combination of a 7XXX alloy containing copper and heat treatment wherein each sheet reaches a temperature of between 6° and 120° C. and preferably between 8° and 100° C. for 8 to 16 hours and preferably 10 to 14 hours.

In the process according to the invention, a bath of liquid metal is produced comprising 4 to 7% by weight of Zn, 1.0 to 3.0% by weight of Cu, 1.5 to 3.5% by weight of Mg, at most 0.50% by weight of Fe, at most 0.40% by weight of Si, at least one element chosen from Zr, Mn, Cr, Sc, Hf and Ti, the amount of said element, if it is chosen, being 0.05 to 0.18% by weight for Zr, 0.1 to 0.6% by weight for Mn, 0.05 to 0.3% by weight for Cr, 0.02 to 0.2% by weight for Sc, 0.05 to 0.5% by weight for Hf and 0.005 to 0.15% by weight for Ti, the other elements being at most 0.05% by weight each and 0.15% by weight in total, the remainder being aluminum.

The zinc content of products according to the invention is between 4 and 7% by weight. In one advantageous embodiment of the invention, the zinc content is at least 5% by weight, preferably at least 5.5% by weight and most preferably at least 5.6% by weight. In one advantageous embodiment of the invention, the zinc content is between 5.5 and 6.2% by weight and preferably between 5.6 and 6.1% by weight. In one advantageous embodiment of the invention, the zinc content is at most 6.5% by weight. In one embodiment of the invention, the zinc content is at most 6.1% by weight. When the zinc content is too high, the suitability for shaping and for assembly may be diminished. When the zinc content is too low, the minimum static mechanical properties may not be achieved.

The copper content of products according to the invention is between 1.0 and 3.0% by weight. In one advantageous embodiment of the invention, the copper content is at least 1.1% by weight, preferably at least 1.2% by weight and most preferably at least 1.3% by weight. In one advantageous embodiment of the invention, the copper content is between 1.2 and 2.0% by weight and preferably between 1.4 and 1.6% by weight. In one advantageous embodiment of the invention, the copper content is at most 2.5% by weight and most preferably at most 2.0% by weight. In one embodiment of the invention, the copper content is at most 1.8% by weight. When the copper content is too high, the suitability for shaping and for assembly may be diminished. When the copper content is too low, the minimum static mechanical properties are not achieved and the corrosion resistance is insufficient.

The magnesium content of products according to the invention is between 1.5 and 3.5% by weight. In one advantageous embodiment of the invention, the magnesium content is at least 1.8% by weight, preferably at least 2.0% by weight and most preferably at least 2.2% by weight. In one advantageous embodiment of the invention, the magnesium content is between 2.2 and 3.0% by weight and preferably between 2.4 and 2.8% by weight. In one advantageous embodiment of the invention, the magnesium content is at most 3.2% by weight and most preferably at most 3.0% by weight. In one embodiment of the invention, the magnesium content is at most 2.8% by weight. When the magnesium content is too high, the suitability for shaping and for assembly may be diminished. When the magnesium content is too low, the minimum static mechanical properties are not achieved and the corrosion resistance is insufficient.

The iron and silicon content is at most 0.5% by weight and 0.4% by weight respectively. In one advantageous embodiment of the invention, the iron and silicon content is at most 0.2% and most preferably at most 0.15% by weight. In one advantageous embodiment of the invention, the iron content is between 0.05 and 0.25% by weight and preferably between 0.15 and 0.20% by weight. In one advantageous embodiment of the invention, the silicon content is between 0.03 and 0.15% by weight and preferably between 0.06 and 0.12% by weight. A controlled and limited iron and silicon content helps to improve the compromise between properties.

The alloy of products according to the invention contains at least one element chosen from Zr, Mn, Cr, Sc, Hf and Ti, the amount of said element, if it is chosen, being 0.05 to 0.18% by weight for Zr, 0.1 to 0.6% by weight for Mn, 0.05 to 0.3% by weight for Cr, 0.02 to 0.2% by weight for Sc, 0.05 to 0.5% by weight for Hf and 0.005 to 0.15% by weight for Ti.

Advantageously, the selected elements are chromium and titanium, with the chromium content being between 0.15 and 0.25% by weight, preferably between 0.17 and 0.23% by weight and most preferably between 0.18 and 0.22% by weight and the titanium content being between 0.01 and 0.10% by weight, preferably between 0.02 and 0.06% by weight. The addition of titanium, possibly combined with boron and/or carbon, helps to control the granular structure, in particular during casting.

In another embodiment, the selected elements are zirconium and titanium, with the zirconium content being between 0.07 and 0.15% by weight, preferably between 0.08 and 0.13% by weight and most preferably between 0.09 and 0.12% by weight and the titanium content being between 0.01 and 0.10% by weight, preferably between 0.02 and 0.06% by weight.

The other elements are inevitable impurities, which are maintained at a content of less than or equal to 0.05% by weight each and 0.15% by weight in total.

Advantageously, the alloy is one of AA7010, AA7012, AA7022, AA7122, AA7023, AA7032, AA7033, AA7040, AA7140, AA7050, AA7050A, AA7150, AA7250, AA7075, AA7175, AA7475, and preferably AA7010, AA7050, AA7075, AA7175 and AA7475.

The process for manufacturing thin sheets according to the invention then comprises the steps of casting, optional homogenization, hot rolling and optional cold rolling, solution heat treatment, quenching, optional leveling and/or controlled traction, heat treatment and aging.

The bath of liquid metal produced is cast in the form of a rolling ingot.

The rolling ingot is then, optionally, homogenized at a temperature of between 450° C. and 500° C. The homogenization period is preferably between 5 and 60 hours. Advantageously, the homogenization temperature is at least 460° C. In one embodiment, the homogenization temperature is below 490° C.

Following homogenization, the rolling ingot is generally cooled to ambient temperature before being pre-heated for the purpose of being hot formed. The aim of pre-heating is to reach a hot rolling inlet temperature, which is preferably between 35° and 450° C., permitting forming by hot rolling.

Hot rolling is performed such as to obtain a sheet with a typical thickness of 3 to 8 mm.

Following hot rolling, it is possible to optionally cold roll the sheet obtained, in particular to obtain a final thickness of between 0.4 and 4 mm. The final thickness is preferably at most 3.0 mm and more preferably at most 2.5 mm. Advantageously, the final thickness is at least 0.5 mm and preferably at least 0.8 mm.

The sheet obtained is then solution heat treated at between 45° and 515° C. Solution heat treatment may be performed sheet by sheet in a furnace, with the time in solution in this embodiment being advantageously between 1 minute and 1 hour. In another embodiment, solution heat treatment is performed on a continuous processing line, with the time in solution in this embodiment being advantageously between 5 seconds and one minute. The solution heat treated sheet is then quenched. Advantageously, quenching is performed using water, the temperature of which is between 2° and 60° C. and preferably between 3° and 50° C.

It is known to a person skilled in the art that the precise conditions for solution heat treatment must be selected on the basis of thickness and composition, in order to place hardening elements in a solid solution.

The sheet can then be subject to cold forming by leveling and/or controlled traction with permanent deformation of at least 0.5% and less than 3%.

Heat treatment wherein said sheet reaches a temperature of between 6° and 120° C. for 8 to 16 hours and preferably between 8° and 100° C. for 10 to 14 hours is then performed; the specified temperatures of 120° C. and 100° C. are the maximum temperatures that can be reached by the sheet during heat treatment. In other embodiments of the invention, the maximum temperature reached by the sheet is 110° C. or 105° C. or 95° C. or 90° C. In one embodiment, heat treatment is performed at the outlet of a continuous solution heat treatment and quenching line. In this embodiment, following quenching, the sheet is re-heated to a sufficient temperature to ensure that, after coiling, the sheet reaches a temperature of between 6° and 120° C. for 8 to 16 hours and preferably between 8° and 100° C. for 10 to 14 hours, advantageously, the sheet is cooled after quenching to a temperature of between 2° and 40° C. and re-heated to a temperature of between 7° and 90° C. then cooled slowly to ensure that the temperature is maintained at a temperature of at least 60° C. for at least 10 hours. Finally, the heat treated product is aged for at least 30 days at ambient temperature.

The present inventors have found that if heat treatment is too short and/or if its temperature is insufficient, the mechanical properties of the sheet are too unstable. Preferably, the change in Rp0.2(TL) during the aging step is less than 15 MPa, preferably less than 10 MPa and most preferably less than 7 MPa. Furthermore, the present inventors have found that if heat treatment is too short and/or if its temperature is insufficient, the mechanical properties of the sheet do not permit satisfactory shaping, in particular cold shaping. If heat treatment is too long and/or if its temperature is too high, the mechanical properties of the sheet are stable, but the mechanical strength is too high and/or the formability is too low to allow the shaping and assembly operations to be performed in a satisfactory manner.

In an advantageous embodiment of the invention, following the aging step, h) a shaping operation is performed on said sheet with local deformation reaching at least 2%, i) the shaped sheet is assembled on a body in white motor vehicle, preferably by welding or riveting, j) baking is performed wherein said sheet reaches a temperature of between 16° and 200° C. and preferably between 17° and 190° C. for 15 minutes to 1 hour.

In one embodiment, the shaping operation is performed by stamping at a temperature of between 15° and 250° C. This embodiment is particularly advantageous for shaping in which deformation is significant, typically locally reaching at least 5%.

In another embodiment, the shaping operation is performed by rolling or bending or stamping at ambient temperature, which is advantageous, in particular where deformation is lower, typically locally reaching less than 5%.

The products obtained by means of the process according to the invention are particularly suited to riveting operations with other products, in particular made from aluminum. Advantageously, it is possible to rivet a product according to the invention with an AA5182 alloy in the O-state without cracking the product and obtaining a high static resistance, in particular above 150 daN, during cross tension testing.

The rolled products obtainable by means of the process according to the invention offer a combination of properties $R_{p0.2}$(TL) and A % (TL) such that A % (TL)≥−0.05 $R_{p0.2}$(TL)+40 and A % (TL) is equal to at least 17% and preferably at least 18%. As the test pieces used have a width of 20 mm and a length of 80 mm, i.e. type 2 in accordance with Table B.1 of standard EN ISO 6892-1, the elongation may also be recorded as A80% (TL).

Advantageously, the r/t ratio in the direction TL, which is the relationship between the bending radius (r) determined in accordance with standards ASTM E290-97a and FLTM BB114-02 and the thickness of the sheet (t), expressed in mm, is at most 2.25 and preferably at most 2.0 for the rolled products according to the invention. In one embodiment, the rolled products according to the invention have a yield strength $R_{p0.2}$(TL) of at least 370 MPa and preferably at least 380 MPa, and an elongation at break A % (TL) of at least 19% and preferably at least 20%. In another embodiment, the rolled products according to the invention have a yield strength $R_{p0.2}$(TL) of at least 430 MPa and preferably at least 440 MPa, and an elongation at break A % (TL) of at least 18% and preferably at least 19%.

Advantageously, the mechanical properties of rolled products according to the invention are obtained after aging for 30 days at ambient temperature following heat treatment.

The mechanical properties of products according to the invention after the baking step, which can typically be performed during paint baking, are particularly advantageous. Advantageously, the products according to the invention, after baking, have a yield strength $R_{p0.2}$(TL) of at least 450 MPa, preferably at least 470 MPa and most preferably at least 490 MPa, and a breaking strength $R_m$(TL) of at least 510 MPa, preferably at least 530 MPa and most preferably at least 540 MPa.

Stress corrosion resistance after baking rolled products according to the invention is high. Stress corrosion is typically assessed by means of a test in which stress is obtained by 4-point bending to 75% of the yield strength and the conditions are defined by ASTM G85. Advantageously, the products according to the invention after baking do not display any stress corrosion cracking before 15 days and preferably before 30 days.

The use of rolled products obtainable by means of the process according to the invention or according to the invention for the manufacture of a motor vehicle is advantageous, in particular for structural parts, typically anti-intrusion structural parts.

EXAMPLES

Example 1

In this example, a bath of liquid metal alloy was produced, the composition of which is provided in Table 1. A rolling ingot was cast from this bath of liquid metal.

Said rolling ingot was hot and cold-rolled to give a sheet with a thickness of 1.5 mm. The sheet obtained was solution heat treated at 480° C. for 10 minutes and then quenched.

TABLE 1

| Composition of the cast alloy as a % by weight | | | | | | |
|---|---|---|---|---|---|---|
| Si | Fe | Cu | Mg | Zn | Cr | Ti |
| 0.06 | 0.09 | 1.55 | 2.64 | 6.02 | 0.19 | 0.02 |

Various heat treatments, as listed in Table 2, were performed and the mechanical properties measured after waiting for 0 to 90 days. After this waiting period, a baking treatment for 20 minutes at 185° C., simulating paint baking, was performed and the mechanical properties were also measured.

The static mechanical properties were characterized in the direction TL (long crosswise direction) and are provided in Table 2. The test pieces used had a width of 20 mm and a length of 80 mm, i.e. type 2 in accordance with Table B.1 of standard EN ISO 6892-1.

TABLE 2

| Static mechanical properties | | | | | | | |
|---|---|---|---|---|---|---|---|
| Heat treatment/ quenching | Days | Without Baking | | | With Baking at 185° C.-20 minutes | | |
| water temperature | after heat treatment | $R_{p0.2}$ (TL) (MPa) | $R_m$ (TL) (MPa) | A (TL) (%) | $R_{p0.2}$ (TL) (MPa) | $R_m$ (TL) (MPa) | A (TL) (%) |
| None/20° C. | 0.05 | 264 | 450 | 20.1 | | | |
| (T4) | 89.87 | 391 | 564 | 20.2 | 413 | 494 | |
| 120° C. | 0 | 530 | 601 | 13.8 | 517 | 567 | 11.6 |
| 24 h/20° C. | 30 | 530 | 601 | 13.8 | 517 | 567 | 11.6 |
| 80° C. | 0 | 383 | 548 | 21.0 | 507 | 560 | 11.5 |
| 8 h/20° C. | 30 | 389 | 549 | 20.6 | 498 | 554 | 12.5 |
| | 60 | 401 | 562 | 20.8 | 502 | 559 | 12.1 |
| | 90 | 405 | 563 | 20.4 | 500 | 557 | 11.9 |
| 80° C. | 0 | 396 | 548 | 20.1 | 507 | 559 | 11.3 |
| 8 h/40° C. | 30 | 404 | 554 | 20.3 | 506 | 559 | 11.5 |
| | 60 | 406 | 563 | 20.4 | 501 | 556 | 10.8 |
| | 90 | 410 | 566 | 20.2 | 498 | 554 | 10.9 |
| 100° C. | 0 | 445 | 564 | 18.0 | 522 | 571 | 12.2 |
| 8 h/40° C. | 30 | 447 | 568 | 18.0 | 518 | 569 | 12.1 |
| | 60 | 459 | 577 | 17.4 | 525 | 574 | 11.7 |
| | 90 | 455 | 574 | 17.6 | 529 | 578 | 11.9 |
| 80° C. | 0 | 365 | 531 | 18.9 | 497 | 555 | 11.7 |
| 3 h/20° C. | 30 | 394 | 555 | 18.3 | 503 | 558 | 11.1 |
| 80° C. | 0 | 383 | 541 | 19.0 | 504 | 557 | 11.6 |
| 6 h/20° C. | 30 | 398 | 553 | 17.3 | 504 | 557 | 11.2 |

The bending radii were also measured in the direction L and the direction TL and the corresponding r/t ratios in accordance with standard ASTM E290-97a and the "Ford Laboratory Test Method" (FLTM) BB114-02. The results are provided in Table 3.

TABLE 3

| Results of bending tests | | | | | |
|---|---|---|---|---|---|
| Heat treatment/ quenching water temperature | Days after heat treatment | Bending radius TL (r), mm | r/t | Bending radius L (r), mm | r/t |
| None/ | 0.05 | 1 | 0.4 | 1.5 | 0.5 |
| 20° C. | 89.87 | 3.5 | 2.3 | 4 | 2.7 |
| 120° C. 24 h/ | 0 | 3.50 | 2.33 | 4.50 | 3.00 |
| 20° C. | 30 | 3.50 | 2.33 | 4.50 | 3.00 |
| 80° C. 8 h/ | 0 | 2.50 | 1.67 | 2.50 | 1.67 |
| 20° C. | 30 | 2.75 | 1.83 | 2.75 | 1.83 |
| | 60 | 2.75 | 1.83 | 2.75 | 1.83 |
| | 90 | 3.00 | 2.00 | 3.00 | |
| 80° C. 8 h/ | 0 | 2.50 | 1.67 | 3.00 | 2.00 |
| 40° C. | 30 | 2.75 | 1.83 | 3.25 | 2.17 |
| | 60 | 3.00 | 2.00 | 3.50 | 2.33 |
| | 90 | 3.00 | 2.00 | 3.50 | 2.33 |
| 100° C. 8 h/ | 0 | 2.75 | 1.83 | 3.00 | 2.00 |
| 40° C. | 30 | 2.75 | 1.83 | 3.50 | 2.33 |
| | 60 | 3.00 | 2.00 | 3.50 | 2.33 |
| | 90 | 3.00 | 2.00 | 3.50 | 2.33 |
| 80° C. 3 h/ | 0 | 1 | 0.4 | 1.5 | 0.5 |
| 20° C. | 30 | 3.5 | 2.3 | 4 | 2.7 |

TABLE 3-continued

| Results of bending tests | | | | | |
|---|---|---|---|---|---|
| Heat treatment/ quenching water temperature | Days after heat treatment | Bending radius TL (r), mm | r/t | Bending radius L (r), mm | r/t |
| 80° C. 6 h/ 20° C. | 0 | 3.50 | 2.33 | 4.50 | 3.00 |
| | 30 | 3.50 | 2.33 | 4.50 | 3.00 |

Example 2

In this example, a bath of liquid metal alloy was produced, the composition of which is provided in Table 4. A rolling slab was cast from this bath of liquid metal. The rolling ingot was homogenized for 19 hours at 475° C.

Said rolling ingot was hot and cold-rolled to give a sheet with a thickness of 1.5 mm. The sheet obtained was solution heat treated in a tunnel furnace at 500° C. for 25 seconds and then quenched with water at 20° C. to ambient temperature, then leveled with an elongation of 0.2%.

TABLE 4

| Composition of the cast alloy as a % by weight | | | | | | |
|---|---|---|---|---|---|---|
| Si | Fe | Cu | Mg | Zn | Cr | Ti |
| 0.10 | 0.17 | 1.52 | 2.61 | 5.88 | 0.19 | 0.02 |

A heat treatment was then performed by re-heating the sheet to a temperature of 80° C. before rolling it into a coil and maintaining a temperature above 60° C. for 10 hours, the mechanical properties were then measured after waiting for 4 to 62 days. After this waiting period, a baking treatment for 20 minutes at 185° C., simulating paint baking, was performed and the mechanical properties were also measured.

The static mechanical properties were characterized in the direction TL and are provided in Table 5. The test pieces used had a width of 20 mm and a length of 80 mm, i.e. type 2 in accordance with Table B.1 of standard EN ISO 6892-1.

TABLE 5

| Static mechanical properties | | | | | | |
|---|---|---|---|---|---|---|
| Time, | Without Baking | | | With Baking at 185° C.-20 minutes | | |
| days after heat treatment | $R_{p0.2}$ (TL) (MPa) | $R_m$ (TL) (MPa) | A (TL) (%) | $R_{p0.2}$ (TL) (MPa) | $R_m$ (TL) (MPa) | A (TL) (%) |
| 4 | 389 | 538 | 21.0 | 485 | 539 | 11.1 |
| 35 | 400 | 541 | 20.1 | 492 | 546 | 11.9 |
| 62 | 403 | 551 | 20.2 | 494 | 548 | 11.8 |

Example 3

In this example, the riveted assembly of sheets having a thickness of 1.2 mm in AA5182 alloy with a sheet having a thickness of 1.5 mm in the example 2 was tested. The sheet was subject to treatment for 1 minute at 200° C. to simulate a shaping operation by means of stamping. For comparison, the assembly with a sheet in AA7075 alloy having been subject to heat treatment for 24 hours at 120° C. was also tested.

An assembly was created with the configuration 5182 O 1.2 mm/7XXX 1.5 mm with a standard K50E46AM rivet with a length of 4.5 mm and a reference matrix EHG14032 from Henrob, by applying a force of between 65 and 85 kN to obtain a flush finish of substantially 0 mm for the head of the rivet with the sheet at the top of the assembly (5182 0 1.2 mm).

Figure 2:
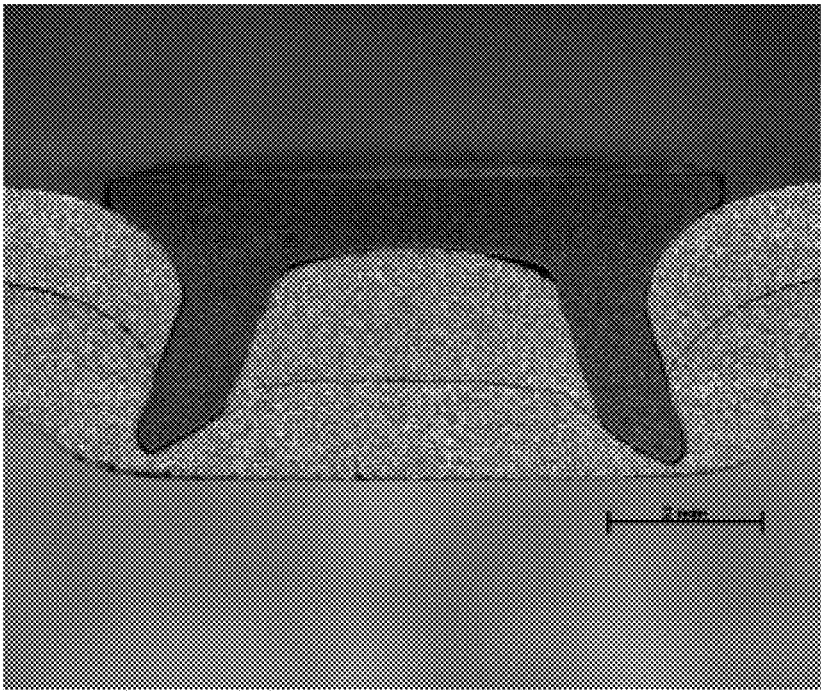
FIG. 2: Cross section of the riveted assembly of sheets having a thickness of 1.2 mm in AA5182 alloy with a sheet having a thickness of 1.5 mm in the example 2 according to the invention.
Figure 3:
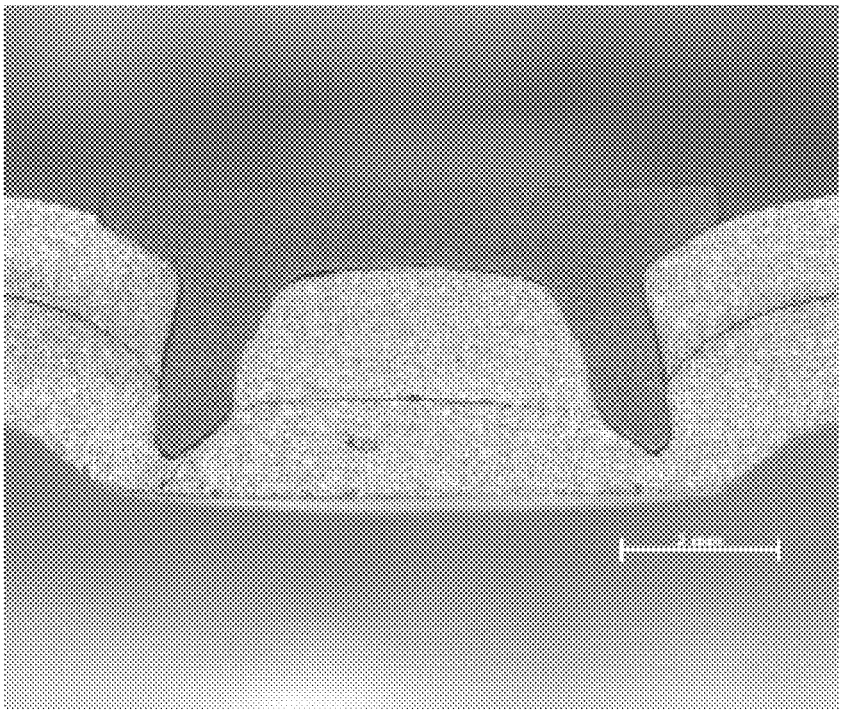
FIG. 3: Cross section of the riveted assembly of sheets having a thickness of 1.2 mm in AA5182 alloy with a sheet having a thickness of 1.5 mm in the reference example 2.

With the sheet according to the invention, no cracks were detected, as illustrated by FIG. 2. With the sheet in 7075 alloy having been subject to heat treatment for 24 hours at 120° C., cracks were observed, as illustrated in FIG. 3.

Furthermore, the mechanical properties of the assembly with the sheet according to the invention were tested by means of a shear test or cross tension test.

The results are provided in Table 6.

TABLE 6

| Mechanical properties of the riveted assembly. | | |
|---|---|---|
| Maximum force (daN) | condition after assembly | condition after assembly + treatment for 20 minutes at 170° C. |
| shear | 326 | 349 |
| cross tension testing | 268 | 279 |

Configuration 5182 O 1.2 mm/Invention 1.5 mm with the rivet described above does not display any cracks and good static resistance, in particular greater than 150 daN during cross tension testing.

The invention claimed is:

1. A process for manufacturing a rolled product based on an aluminum alloy, optionally for the automotive industry wherein, successively, a) making a bath of liquid metal from an aluminum-based alloy comprising 4 to 7% by weight of Zn, 1.0 to 3.0% by weight of Cu, 1.5 to 3.5% by weight of Mg, at most 0.50% by weight of Fe, at most 0.40% by weight of Si, at least one element chosen from Zr, Mn, Cr, Sc, Hf and Ti, the amount of said element, if it is chosen, being 0.05 to 0.18% by weight for Zr, 0.1 to 0.6% by weight for Mn, 0.05 to 0.3% by weight for Cr, 0.02 to 0.2% by weight for Sc, 0.05 to 0.5% by weight for Hf and 0.005 to 0.15% by weight for Ti, the other elements being at most 0.05% by weight each and 0.15% by weight in total, the remainder being aluminum, b) casting a rolling ingot from the bath of liquid metal, c) optionally, the rolling ingot is homogenized, d) hot rolling and optionally cold-rolling the rolling ingot to give a sheet, e) solution heat treating and quenching the sheet, f) optionally, leveling the sheet and/or subjecting to controlled traction with cumulative deformation of at least 0.5% and less than 3%, g) performing heat treatment wherein the sheet reaches a temperature of between 6° and 120° C. for 8 to 16 hours, h) aging the sheet for at least 30 days at ambient temperature.

2. The process according to claim 1 wherein the thickness of the sheet is between 0.4 and 4 mm after the hot rolling and after the optional cold rolling.

3. The process according to claim 1 wherein during the heat treatment in g) the sheet reaches a temperature of between 8° and 100° C. for 10 to 14 hours.

4. The process according to claim 1 wherein the heat treatment in g) is performed at the outlet of a continuous solution heat treatment and quenching line, with the sheet being re-heated to a sufficient temperature to ensure that, after a coiling, the sheet reaches a temperature of between 6° and 120° C. for 8 to 16 hours.

5. The process according to claim 4 wherein the sheet is cooled after quenching to a temperature of between 2° and 40° C. and re-heated to a temperature of between 7° and 90° C. then cooled slowly to ensure that the temperature is maintained at a temperature of at least 60° C. for at least 10 hours.

6. The process according to claim 1 wherein quenching is performed using water, the temperature of which is between 2° and 60° C.

7. The process according to claim 1 wherein said alloy is one of AA7010, AA7012, AA7022, AA7122, AA7023, AA7032, AA7033, AA7040, AA7140, AA7050, AA7050A, AA7150, AA7250, AA7075, AA7175, AA7475.

8. The process according to claim 1 wherein the change in $R_{p0.2}$(TL) during h) is less than 15 MPa.

9. The process according to claim 1 wherein after h), i) a shaping operation is performed on said sheet with local deformation reaching at least 2%, j) the shaped sheet is assembled on a body in white motor vehicle, optionally by welding or riveting, k) baking is performed wherein the sheet reaches a temperature of between 16° and 200° C. for 15 minutes to 1 hour.

10. The process according to claim 9 wherein the shaping operation is performed by stamping at a temperature of between 15° and 250° C.

11. The process according to claim 9 wherein the shaping operation is performed by profiling or bending or stamping at ambient temperature.

12. The process according to claim 1 wherein the aluminum-based alloy comprises 5.5 to 6.2% by weight of Zn.

13. The process according to claim 1 wherein the aluminum-based alloy comprises 1.2 to 2.0% by weight of Cu.

14. The process according to claim 1 wherein the aluminum-based alloy comprises 2.2 to 3.0% by weight of Mg.

15. The process according to claim 1 wherein the aluminum-based alloy comprises 0.05 to 0.25% by weight of Fe.

16. The process according to claim 1 wherein the aluminum-based alloy comprises 0.03 to 0.15% by weight of Si.

17. The process according to claim 1 wherein no shaping operation is performed on said sheet before step h.

18. The process according to claim 1 wherein the thickness of the sheet is between 0.8 and 3 mm after the hot rolling and after the optional cold rolling.

19. The process according to claim 1 wherein the heat treatment in g) is performed at the outlet of a continuous solution heat treatment and quenching line, with the sheet being re-heated to a sufficient temperature to ensure that, after a coiling, the sheet reaches a temperature of between 8° and 100° C. for 10 to 14 hours.

20. The process according to claim 1 wherein quenching is performed using water, the temperature of which is between 3° and 50° C.

21. The process according to claim 1 wherein the change in $R_{p0.2}$(TL) during h) is less than 10 MPa.

22. The process according to claim 1 wherein the change in $R_{p0.2}$(TL) during h) is less than 7 MPa.

23. The process according to claim 1 wherein after h), i) a shaping operation is performed on said sheet with local deformation reaching at least 2%, j) the shaped sheet is assembled on a body in white motor vehicle, optionally by welding or riveting, k) baking is performed wherein the sheet reaches a temperature of between 17° and 190° C. for 15 minutes to 1 hour.

* * * * *